US008430040B2

(12) United States Patent
Creighton

(10) Patent No.: US 8,430,040 B2
(45) Date of Patent: Apr. 30, 2013

(54) INCREASED CAPACITY RAILCAR AND METHOD

(75) Inventor: George S. Creighton, Double Oak, TX (US)

(73) Assignee: Trinity Industries, Inc., Dallas, TX (US)

( * ) Notice: Subject to any disclaimer, the term of this patent is extended or adjusted under 35 U.S.C. 154(b) by 253 days.

(21) Appl. No.: 12/922,002

(22) PCT Filed: Mar. 13, 2009

(86) PCT No.: PCT/US2009/037137

§ 371 (c)(1), (2), (4) Date: Sep. 10, 2010

(87) PCT Pub. No.: WO2009/114793

PCT Pub. Date: Sep. 17, 2009

(65) Prior Publication Data

US 2011/0005425 A1 Jan. 13, 2011

Related U.S. Application Data

(60) Provisional application No. 61/036,312, filed on Mar. 13, 2008.

(51) Int. Cl.
*B61D 17/00* (2006.01)

(52) U.S. Cl.
USPC ..... 105/404

(58) Field of Classification Search ..... 105/238.1, 105/239, 244, 247, 396, 404, 406.1, 406.2, 105/407, 409

See application file for complete search history.

(56) References Cited

U.S. PATENT DOCUMENTS

| | | | | |
|---|---|---|---|---|
| 3,866,545 | A | 2/1975 | Heap | |
| 4,633,787 | A * | 1/1987 | Przybylinski et al. | 105/406.1 |
| 5,433,501 | A | 7/1995 | Thomas et al. | |
| 6,302,031 | B1 * | 10/2001 | Smith et al. | 105/404 |
| 2002/0148196 | A1 | 10/2002 | Barry et al. | |
| 2006/0207472 | A1 | 9/2006 | Creighton | |

* cited by examiner

*Primary Examiner* — Robert McCarry, Jr.
(74) *Attorney, Agent, or Firm* — Baker Botts L.L.P.

(57) ABSTRACT

A railway car includes a railway car underframe having a first longitudinal side sill and a second longitudinal side sill with at least one sidewall assembly disposed along the first longitudinal side sill of the railway car underframe. The sidewall assembly is formed in part from a side sheet, an interior vertical support post, and an exterior vertical support post. A first end of the interior vertical support post and a first end of the exterior vertical support post are each respectively disposed adjacent to the first longitudinal side sill of the railway car underframe. The exterior vertical support post is coupled to an exterior surface of the side sheet. The interior vertical support post is coupled to an interior surface of the side sheet.

25 Claims, 4 Drawing Sheets

INCREASED CAPACITY RAILCAR AND METHOD

RELATED APPLICATION

This application claims priority to PCT Application No. PCT/US2009/037137 filed Mar. 13, 2009 which claims priority to U.S. Provisional Application No. 61/036,312 entitled "Increased Capacity Railcar and Method," filed Mar. 13, 2008. The contents of this application is incorporated herein in its entirety by this reference.

TECHNICAL FIELD

The present invention is related in general to railway cars having one or more straight sides and particularly to railway cars with straight sides formed in part by side sheets and side posts.

BACKGROUND

Railway cars are useful for transporting large amounts of cargo. Although in some applications it is desirable to manufacture large railway cars, the Association of American Railroads (AAR) has placed constraints on the size of railway cars for safety purposes. For example, cross-sectional widths and heights of railway cars are generally limited by applicable AAR clearance limitations, which specify a maximum width and a maximum height of a railway car at the center of the railway car and also specify maximum heights and widths at other locations along the length of the railway car. Because of applicable AAR clearance limitations, designers often increase the cargo carrying capacity of a railway car by increasing the length of the railway car. Unfortunately, as the length of a railway car increases, the width allowed by applicable AAR clearance limitations decrease to take into account the travel of the railway car around a curve. While traveling around a curve, a portion of a railway car may extend outside a clearance plane specified by AAR limitations, which is not acceptable. Therefore, stricter width clearance limitations are applied to longer railway cars to avoid a long railway car making contact with a structure adjacent the railroad.

Thus, AAR clearance limitations also generally limit the width-to-length ratio at which a railway car may be constructed and therefore further restrict cargo carrying capability of a railway car. The amount of cargo a railway car may carry directly impacts profitability of a railway carrier and is therefore important. Thus, maximizing the amount of cargo a railway car can carry while staying within AAR clearance limitations is desirable.

SUMMARY

In accordance with a particular embodiment, a railway car includes a railway car underframe having a first longitudinal side sill and a second longitudinal side sill with at least one sidewall assembly disposed along the first longitudinal side sill of the railway car underframe. The sidewall assembly is formed in part from a side sheet, an interior vertical support post, and an exterior vertical support post. A first end of the interior vertical support post and a first end of the exterior vertical support post are each respectively disposed adjacent to the first longitudinal side sill of the railway car underframe. The exterior vertical support post is coupled to an exterior surface of the side sheet. The interior vertical support post is coupled to an interior surface of the side sheet.

In accordance with a particular embodiment, a railway car includes a railway car underframe having a first longitudinal side sill and a second longitudinal side sill with a first sidewall assembly disposed along the first longitudinal side sill of the railway car underframe and a second sidewall assembly disposed along the second longitudinal side sill of the railway car underframe. Each of the first and second sidewall assemblies include first and second side sheets, a plurality of interior vertical support posts proximate a center of the railway car, and a plurality of exterior vertical support posts positioned between the plurality of interior vertical support posts and an end of the railway car. Each exterior vertical support post is coupled to an exterior surface of a side sheet of the first and second side sheets, and each interior vertical support post is coupled to an interior surface of a side sheet of the first and second side sheets.

In accordance with a particular embodiment, a method of forming a railway car includes coupling first and second sidewall assemblies to a railway car underframe. Each of the first and second sidewall assemblies include first and second side sheets, a plurality of interior vertical support posts proximate a center of the railway car, and a plurality of exterior vertical support posts positioned between the plurality of interior vertical support posts and an end of the railway car. Each exterior vertical support post is coupled to an exterior surface of a side sheet of the first and second side sheets, and each interior vertical support post is coupled to an interior surface of a side sheet of the first and second side sheets.

Technical advantages of particular embodiments include a railway car with exterior and interior support posts positioned to give the railway car an hourglass formation. This increases cargo carrying capacity and length while the railway car remains within applicable AAR clearance limitations. Also, a railway car may be made shorter than corresponding conventional railway cars, while having the same or greater cargo carrying capacity. Moreover, the exterior and interior configuration of the support posts disclosed herein provide a solid structure for the railcar despite adding discontinuities which, in the past, have been discouraged and avoided.

Further technical advantages of particular embodiments include vertical support posts disposed on the interior of the railway car to reduce or eliminate cavities where lading might become lodged. Such interior vertical support posts may have a modified hat-shaped cross section that includes legs that gently slope away from a center portion of the post.

Other technical advantages will be readily apparent to one of ordinary skill in the art from the following figures, descriptions, and claims. Moreover, while some specific advantages have been enumerated above, various embodiments may include all, some, or none of the enumerated advantages.

BRIEF DESCRIPTION OF THE DRAWINGS

A more complete understanding of embodiments of the invention will be apparent from the detailed description taken in conjunction with the accompanying drawings in which.

DETAILED DESCRIPTION

Figure 1:
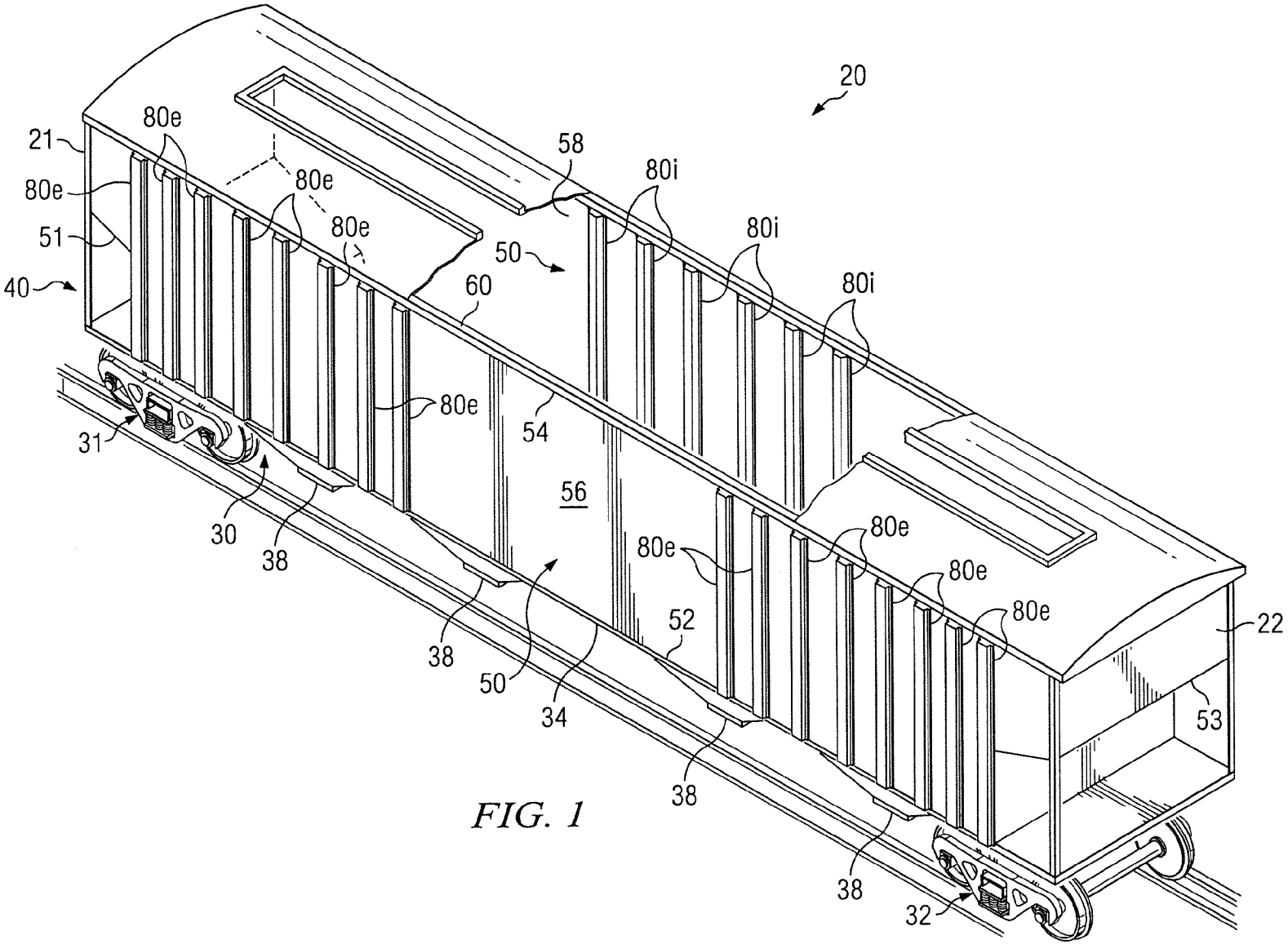
FIG. 1 illustrates an isometric view, with portions broken away, of a railway car in accordance with an embodiment of the present disclosure.
Figure 2A:
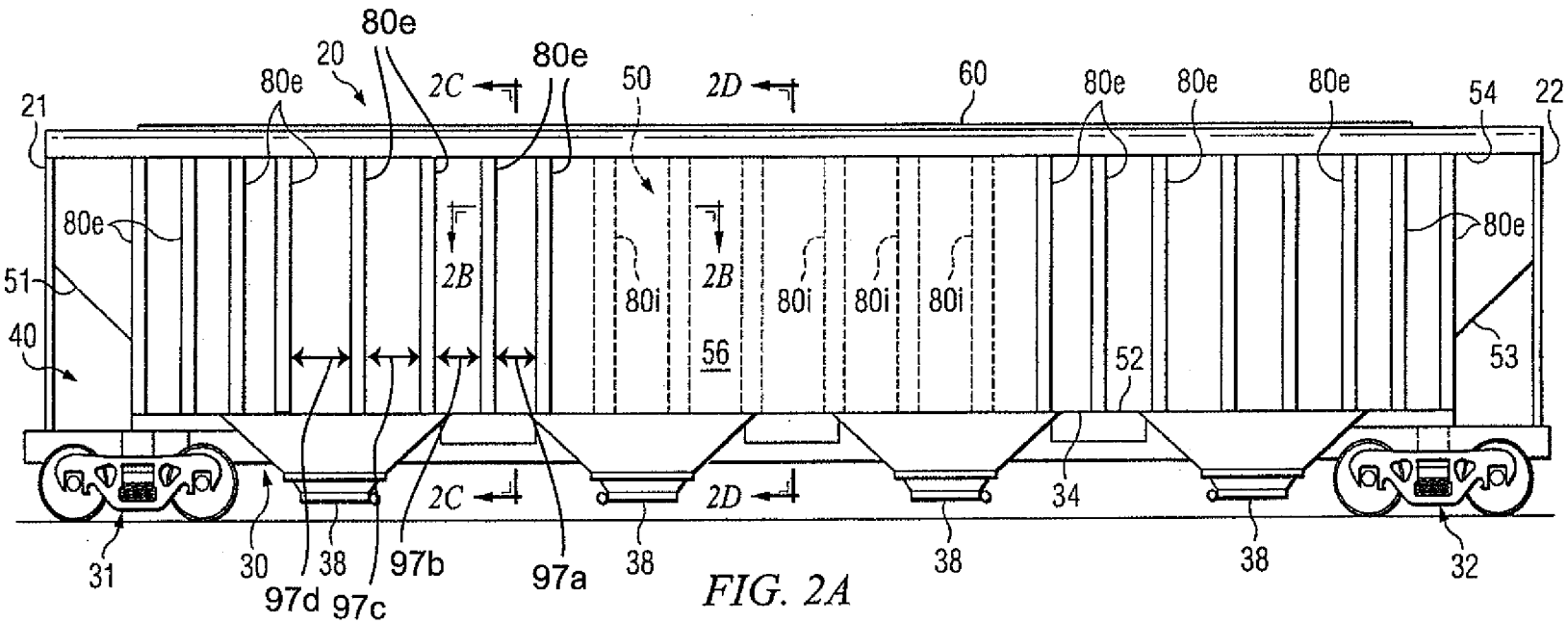
FIG. 2A is a side view of a railway car in accordance with an embodiment of the present disclosure.
Figure 2B:
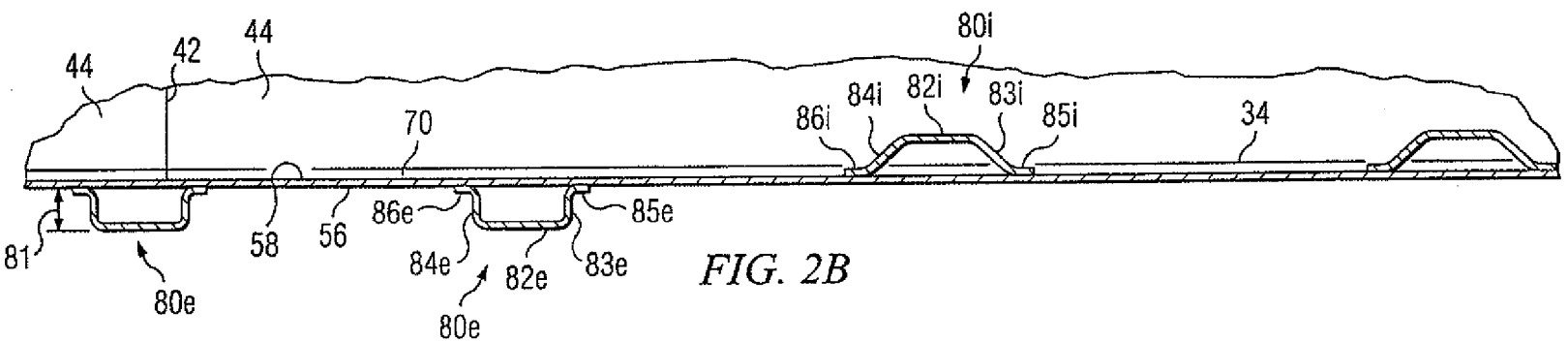
FIG. 2B is a schematic drawing illustrating a partial cross section of the railway car illustrated in FIG. 2A, taken along lines 2B-2B of FIG. 2A, showing cross sections of vertical support posts in accordance with an embodiment of the present disclosure.
Figure 2C:
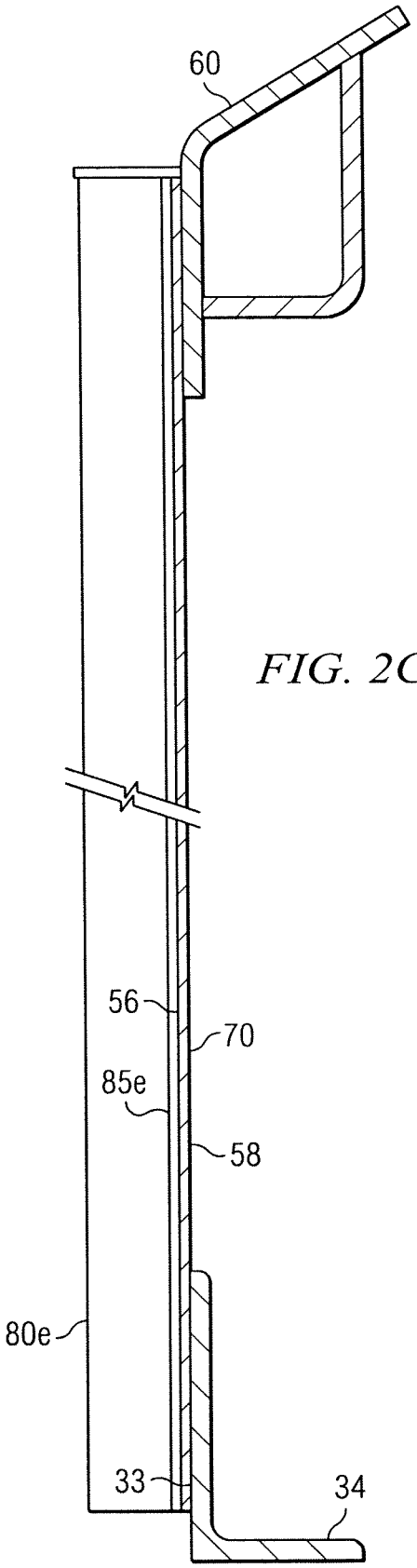
FIG. 2C is a schematic drawing illustrating a partial cross section of the railway car of FIG. 2A, taken along lines 2C-2C of FIG. 2A, showing an exterior vertical support post in accordance with an embodiment of the present disclosure.
Figure 2D:
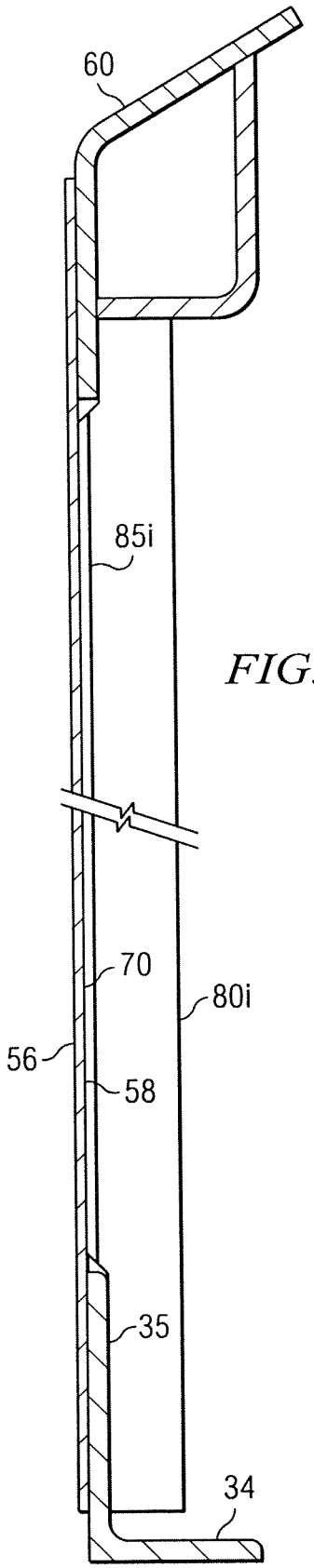
FIG. 2D is a schematic drawing of a partial cross section of the railway car illustrated in FIG. 2A, taken along lines 2D-2D of FIG. 2A, showing an interior vertical support post in accordance with an embodiment of the present disclosure.
Figure 3:
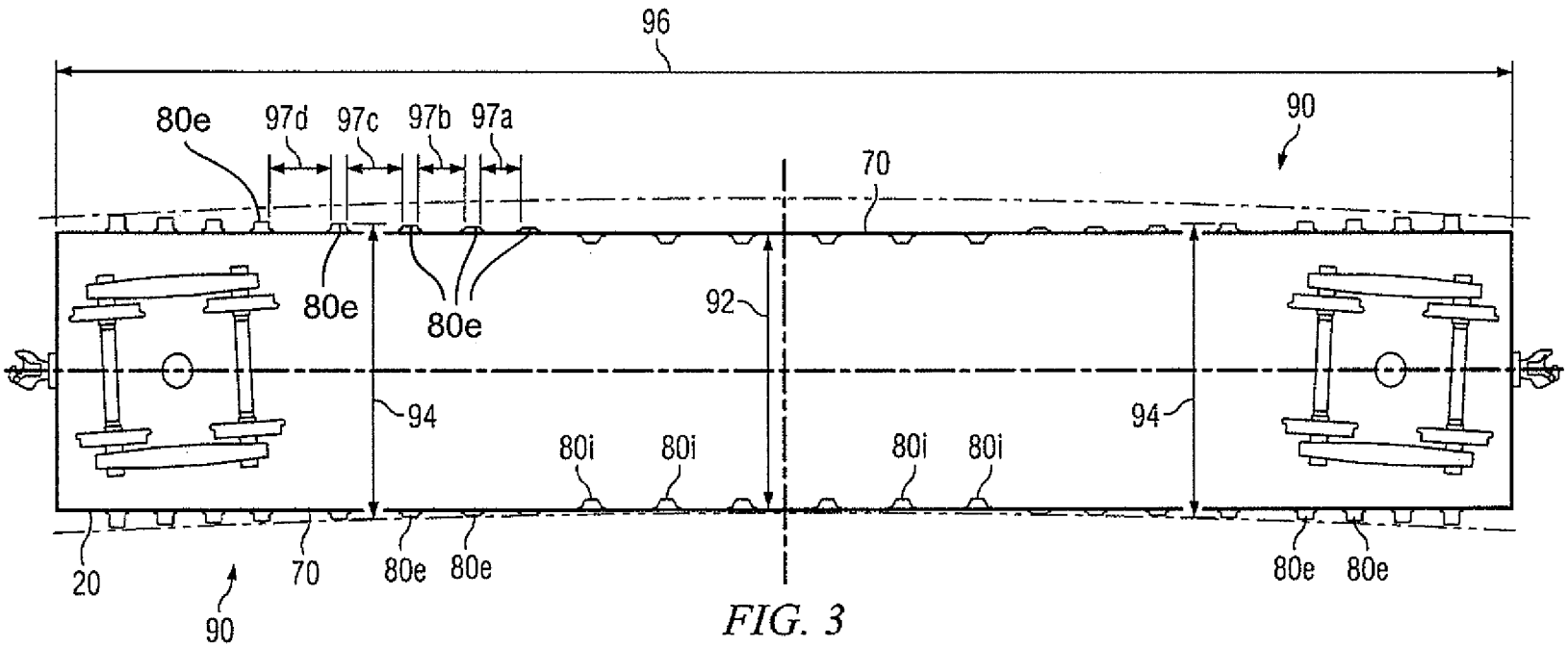
FIG. 3 is a schematic drawing of the railway car illustrated in FIGS. 1-2D showing an exterior configuration of the railway car in the illustrated plane and also showing the relationship between the exterior configuration and a required curve clearance profile.

Preferred embodiments of the disclosure and some advantages are best understood by reference to FIGS. 1-3 wherein like number refer to same and like parts.

The terms "side post," "side post" "support post," and "support post" may be used in this application to describe any post operable to support side sheets of a sidewall or sidewall assembly associated with a railway car. Corner posts, typically located at respective joints between side walls and end walls, may sometimes be included in the definition of "side post," "side post," "support post," and "support post" for purposes of describing and claiming various features of the present invention.

For purposes of illustration, the present disclosure may be described with respect to railway cars such as gondola cars and/or hopper cars. Examples of such railway cars are shown and described in U.S. Pat. No. 5,209,166, entitled "Railway Hopper Car Bolster Assembly"; U.S. Pat. No. 4,633,787 entitled "Light Weight Gondola Type Railway Car"; U.S. Pat. No. 3,844,229, entitled "Railway Hopper Car End Structure Assembly"; and U.S. Pat. No. 3,785,754, entitled "Rapid Discharge Hopper Car". Although the present disclosure may be generally described with respect to covered railway cars, a sidewall or sidewall assembly incorporating teachings of the present disclosure may be used with a wide variety of railway cars such as open top hopper cars and gondola cars.

FIG. 1 shows railway car 20 having a pair of sidewall assemblies incorporating various teachings of the present disclosure. Railway car 20 may be generally described as a covered hopper car. Railway car 20 may be used for shipment of bulk raw materials. Both sidewall assemblies 50 on each side of railway car 20 may have substantially the same configuration and design.

For some applications railway car 20 includes a railway car underframe indicated generally at 30 with car body 40 mounted thereon. For some applications, railway car underframe 30 and car body 40 may be manufactured from steel alloys. However, various components of both railway car underframe 30 and car body 40 may be satisfactorily formed from various steel alloys, aluminum alloys, fiber reinforced plastic materials, cermets, and composites of these materials as desired. As discussed later in more detail, fabricating a railway car with sidewalls or sidewall assemblies having side posts and side sheets formed in accordance with teachings of the present disclosure may increase load carrying capacity and still allow a railway car to fit within the AAR clearance dimensions.

Railway car underframe 30 may be attached to and mounted on first railway truck assembly 31 adjacent to first end 21 of railway car 20. Railway car underframe 30 may also be attached to and mounted on second railway truck assembly 32 adjacent to second end 22 of railway car 20. Railway car underframe 30 may include a pair of body bolsters (not expressly shown) satisfactory for engagement with respective railway truck assemblies 31 and 32. Various types of commercially available railway car underframes and railway truck assemblies may be satisfactorily used with the present invention.

Car body 40 may include a pair of sidewall assemblies 50 which extend generally parallel with each other along opposite sides of railway car underframe 30. Sidewall assemblies 50 may also be defined in part by respective exterior surfaces 56 and interior surfaces 58. For some applications, sidewall assemblies 50 may be formed from a plurality of generally rectangular side sheets 70 which may be attached to each other using various types of mechanical fasteners and/or welding techniques.

The arrangement of side sheets 70 may be modified depending upon the desired configuration of the resulting sidewall assembly. Side sheets 70 cooperate with each other to form exterior surface 56 and interior surface 58 of associated sidewall assembly 50. Portions of each sidewall 50 and associated side sheets 70 proximate first end 21 and second end 22 of railway car 20 may have generally tapered portions 51 and 53. Side sheets 70 cooperate with each other to form exterior surface 56 and interior surface 58 of associated sidewall 50.

For some applications, railway car underframe 30 may have a generally rectangular configuration defined in part by a pair of side sills 34. Portions of side sill 34 are shown in FIGS. 2A, 2B, 2C, and 2D. Lower edge 52 of sidewall assemblies 50 may be attached to side sill 34, as shown in FIG. 2B.

As shown in FIGS. 2A, 2C, and 2D, top chord 60 may be attached along a respective upper portion of each sidewall assembly 50. Each top chord 60 may include an elongated hollow beam or tube. Each top chord 60 may extend substantially along the full length of respective sidewall assembly 50. Top chord 60 may be welded to adjacent portions of associated sidewall assembly 50.

Various types of mechanical fasteners such as nuts and bolts, drive bolts, blind rivets, and other fasteners may be satisfactorily used with the present invention. Examples of such fasteners are available from Huck International, Inc. located at 6 Thomas, Irvine, Calif. 92718-2585. Power tools satisfactory for installing such fasteners are also available from Huck International and other vendors. For some applications various welding techniques may be used to satisfactorily attach respective top chords 60 with a respective upper portion of each sidewall. Also, a combination of welding techniques and mechanical fasteners may also be satisfactorily used.

For some applications, car body 40 may include a plurality of cross braces and/or diagonal braces (not expressly shown) disposed between interior surfaces 58 of sidewall assemblies 50. Various types of brackets (not expressly shown) may be used to attach the cross braces and diagonal braces with associated portions of side posts 80*i* and 80*e*.

Railway car 20 may include a plurality of support posts or side posts 80*i* and 80*e* which are spaced longitudinally from each other along sidewall assembly 50. Side posts 80 may be on the outside of side sheet 70, and side posts 80*i* may be on the inside of side sheet 70. A particular embodiment may include a total of twenty-two side posts 80*e* and 80*i*. It may include two sections of eight exterior side posts 80*e* separated by a section of six interior side posts 80*i*. For each sidewall assembly 50, one exterior side post 80*i* may be located over a centerline of first truck assembly 31 and another over centerline of second truck assembly 32. A section including exterior side posts 80*e* may extend approximately thirteen feet along sidewall assembly 50. In addition, partitions of railway car 20 may also provide structural support. As such, the spacing of side posts 80*i* and 80*e* may vary depending on the locations of the partitions and the need for vertical support for railway car 20.

For some applications side posts 80*e* and 80*i* may be formed from aluminum or steel alloy materials. Side posts 80*i* and 80*e* may have different configurations and dimensions. In some embodiments the spacing between outside side posts 80*e* may change along the car. For example, the distance between two adjacent outside posts 80*e* may decrease as one moves towards the outside posts 80*e* closest to the center of the railcar. In addition, in some embodiments some outside posts 80*e* closer to the center of the railcar may be shallower, or have a smaller depth, than outside posts 80*e* that are further away from the center of the railcar.

For some applications side sheets 70 may be formed from the same aluminum alloy material as side posts 80*i* and 80*e*. For other applications, side sheets 70 may be formed from steel alloys or other suitable materials.

FIG. 2B shows an enlarged cross section of side assembly 50 shown in FIG. 2A. Side posts 80*i* and 80*e* and an adjacent portion of side sheet 70 are illustrated. Side posts 80*e* may be described as having hat-shaped cross sections defined in part by a generally U-shaped or C-shaped cross section formed in part by web 82*e* with respective legs 83*e* and 84*e* extending therefrom, flange 85*e* extending from leg 83*e* and flange 86*e* extending from leg 84*e*. However, side posts having a wide variety of cross sections such as rectangular, square, circular, oval, U-shaped or C-shaped may be satisfactorily used. As indicated above, in some embodiments, side posts 80 may have varying depths 81. For example, depths 81 of side posts 80*e* may vary as evident in FIG. 3. In some embodiments, the depth 81 of posts 80*e* can range between 2¼ inches and 1¾ inches. In some embodiments, the depth 81 of posts 80*e* can range to 3 inches.

Side posts 80*i* may have modified hat-shaped cross sections formed in part by web 82*i* with respective legs 83*i* and 84*i* extending therefrom. Side posts 80*i* may be an aluminum extrusion. Legs 83*i* and 84*i* may gently slope from web 82*i* to flanges 85*i* and 86*i* respectively. The slope of legs 83*i* and 84*i* may form an obtuse angle with flanges 85*i* and 86*i* respectively. Such configuration of side posts 80*i*, and particularly legs 83*i* and 84*i*, may eliminate cavities where lading might become lodged. Thus, railway car 20 may completely unload its payload. Lading that may be completely unloaded with the benefit of such configuration of interior side posts 80*i* may be a corn byproduct of ethanol production transported in railway car 20.

Various techniques such as mechanical fasteners and/or welding may be satisfactorily used to attach side posts 80*i* and 80*e* with adjacent portions of associated side sheets 70. Side posts 80*i* and 80*e* may be riveted, bolted, glued, or bonded to side sheets 70. Side post 80*e* may have a greater moment of inertia than side post 80*i*. Thus, the configuration of side post 80*e* may be more efficient than the configuration of side post 80*i*. However, the configuration of side post 80*i* may be more aerodynamic than the configuration of side post 80*e*.

Railway car 20 may include a plurality of hoppers defined in part by one or more transfer ridges 42 which extend laterally across the floor of car body 40. Transfer ridges 42 and associated slope sheets 44 cooperate with each other to direct coal or similar lading toward associated discharge door assemblies 38. Each discharge door assembly 38 may include openings (not expressly shown) with a respective door or gate (not expressly shown) attached thereto. Discharge door assemblies 38 allow discharge of bulk lading such as coal by gravity from respective hopper portions of car body 40.

Discharge door assemblies 38 may be disposed adjacent to respective slope sheets 44. Slope sheets 44 may be inclined at an angle with respect to railway car underframe 30. For some applications, partitions (not expressly shown) may be provided within car body 40 to separate discharge door assemblies 38 and associated hopper portions from each other. For some applications, discharge door assemblies 38 may be automatically opened while railway car 20 is in motion to reduce unloading time. Such railway cars may sometimes be referred to as rapid discharge cars. For some applications, railway car 20 may also be modified to accommodate unloading by using rotary dumping equipment and techniques.

FIG. 2C shows a cross section of side assembly 50. FIG. 2C shows side post 80*e* attached to the exterior surface 56 of side sheet 70. Attached to internal surface 58 of side sheet 70 is side sill 34. At the top portion of side sheet 70, top chord 60 is attached to internal surface 58 of side sheet 70. The components shown in FIG. 2C may be welded or mechanically fastened in the configuration shown.

FIG. 2D is a cross-section of side assembly 50 showing interior side post 80*i*. Side post 80*i* may be secured to internal surface 58 of side sheet 70. In addition, side post 80*i* may have a cutout near the bottom of side post 80*i* to accommodate side sill 34. Near the top of side post 80*i* there may be a corresponding cutout to accommodate a portion of top chord 60. Securing internal side post 80*i* to internal surface 58 of side sheet 70 may allow additional clearance toward the middle of railway car 20. The additional clearance may allow railway car 20 to have increased length but still fit within the AAR clearance envelope as discussed below. In some embodiments, interior side posts 80*i* may have a shorter height than exterior side posts 80*e*.

Side sill 34 may have a generally L-shaped cross section and may run substantially along the length of railway car 20 to provide structural support for side assembly including side posts 80*e* and 80*i*. Side sill 34 may have an exterior portion 33 and an interior portion 35. Top chord 60 may be attached along the upper edge of side wall 70. Top chord 60 may include an elongated hollow beam or tube extending substantially along the full length of respective side wall assembly 50.

FIG. 3 is a schematic drawing of railway car 20 showing a relationship between an exterior configuration of railway car 20 and a required curve clearance profile 90. A railway car 20 in accordance with an embodiment of the present disclosure may have a width 92 near the center of railway car 20 that is less than widths 94 near each respective end of railway car 20. By providing this configuration, the cargo carrying capability of railway car 20 may be increased while meeting AAR clearance limitations.

The clearance limitations for widths of railway cars over a certain length require a smaller width near the center of railway car 20 then at its ends. Thus, a configuration utilizing vertical side posts located on the interior of railway car 20 may maximize cargo-carrying space. The increased cargo-carrying capability may arise from the ability to provide a larger railway car 20 having length 96 that is longer than conventional railway cars. Railway car 20 may be longer than convention railway cars because width 92 near the center of railway car 20 is reduced to meet AAR limitations. If width 92 were increased such that width 92 equaled width 94, AAR limitations would require a shorter length, which would reduce cargo carrying capability.

The maximum width of a standard rail car may be 10'8". However, if the railway car is made longer, then it must have a width of less than 10'8" near the center of the railway car. This requirement is governed by AAR limitations in order to ensure that a longer railway car is able to travel around a curve without overhanging a portion of the rail car near the center on the inside of the curve. The standard AAR curve from which the limitations are derived may be a 13° arc and an associated radius of 441.68 feet. In a straight sided rail car, the AAR limitations may be met by making the side sill concave near the center. However, railway cars must be capable of withstanding considerable buff and draft forces during normal operation of the rail car. Incorporating a concave sill and vertical support posts that may not be properly aligned due to the concave nature of the center of the railway car may reduce the railcar's ability to withstand these considerable forces.

In addition, as discussed above, the spacing between outside side posts 80*e* may change along the car. For example, the distance between two adjacent outside posts 80*e* may decrease as one moves towards the outside posts 80*e* closest to the center of the railcar. This is evident in FIG. 3 showing an embodiment with the distance 97 between two adjacent side posts 80*e* decreases as one moves towards the center of the railcar (e.g., distance 97*d* is greater than distance 97*c*, which is greater than distance 97*b*, which is greater than distance 97*a*). In some embodiments, spacing distance between adjacent support posts may range between approximately 1 and 3 feet on a car.

In addition, as discussed above in some embodiments some outside posts 80*e* closer to the center of the railcar may be shallower, or have a smaller depth, than outside posts 80*e* that are further away from the center of the railcar. This too is evident in the embodiment shown in FIG. 3. In some embodiments, the depth of posts 80*e* can range between 2¼ inches and 1¾ inches.

As discussed, the use of interior side posts 80*i* near the center of the railcar and exterior side posts 80*e* away from the center give the railcar a preferred hourglass shape with a width smaller at the center of the railcar and increasing away from the center. In addition, the increasing depth of exterior side posts 80*e* as one moves away from the center further facilitates the hourglass configuration having an increasing width away from the center of the railcar.

Incorporating the teachings of the present disclosure, a railway car that meets applicable AAR limitations may be constructed with all vertical posts being properly aligned and capable of withstanding buff and draft forces experienced by the rail car during normal operation. According to one embodiment, railway car 20 may be a covered hopper car with approximately 7,000 cubic feet of capacity and RDL type gates for rapidly unloading its payload. It may be approximately seventy feet long by ten feet high. However, a variety of other suitable dimensions may be incorporated in accordance with the teachings of an embodiment of the present disclosure.

In contrast, a railway car using conventional construction techniques for a flat sided railway car with vertical posts may be approximately three inches narrower on each side of the car to be within applicable AAR clearance limitations for a constant width railway car which is approximately seventy feet long. Using the teachings of an embodiment of the present disclosure, including interior vertical posts, a seventy foot long railway car may allow recapture of two of the three inches lost using conventional techniques. Thus, each side of the railway car may recapture two inches of cargo carrying capacity along its entire length. These additional four inches may equate to approximately 230 cubic feet of additional capacity.

In general, as a railcar becomes longer as measured between its truck centers, its center width must become narrower. A railcar having a length of approximately 75 feet may require a center width approximately two feet narrower than the center width of a railcar having a length of approximately 42 feet. In some cases, such widths may be approximately 8 feet, 8 inches and 10 feet, 10 inches, respectively. As the length and amount of railcar that becomes narrower increases, the longer the car must become.

In addition to providing increased cargo carrying capacity due to the ability to provide a larger railway car having length 96 that is longer than conventional railway cars while remaining within applicable AAR clearance limitations, other advantages may be provided. For example, for a given required cargo capacity, a car may be constructed according to the teachings of an embodiment of the invention to have a length 96 that is shorter than a conventional length associated with railway cars having similar cargo capacity. A shorter car is generally more maneuverable and lighter than longer cars, and therefore, the ability to provide substantially the same cargo carrying capability with a shorter car is also advantageous. A shorter car may be constructed while maintaining substantially the same cargo carrying capacity because the teachings of the present invention allow increased width required by a shorter car to provide such capacity to fall within applicable AAR limitations.

Although the present invention has been described with reference to particular embodiments, it should be understood that various other changes, substitutions, and alterations may be made hereto without departing from the spirit and scope of the present invention. For example, the position and spacing of vertical side posts along the length of the railway car may be modified to fit a particular length or configuration of an associated railway car or manufacturing or other operational needs.

Numerous other changes, substitutions, variations, alterations, and modifications may be ascertained by those skilled in the art and it is intended that the present invention encompass all such changes, substitutions, variations, alterations, and modifications as falling within the spirit and scope of the appended claims.

What is claimed is:

1. A railway car, comprising:

a railway car underframe having a first longitudinal side sill and a second longitudinal side sill with at least one sidewall assembly disposed along the first longitudinal side sill of the railway car underframe;

the sidewall assembly formed in part from a side sheet, an interior vertical support post, and an exterior vertical support post;

wherein a first end of the interior vertical support post and a first end of the exterior vertical support post are each respectively disposed adjacent to the first longitudinal side sill of the railway car underframe;

wherein the exterior vertical support post is coupled to an exterior surface of the side sheet; and wherein the interior vertical support post is coupled to an interior surface of the side sheet.

2. The railway car of claim 1, wherein a second end of the interior vertical support post and a second end of the exterior vertical support post are each respectively coupled to a top chord of the railway car.

3. The railway car of claim 1, wherein the railway car comprises a car selected from the group consisting of gondola cars, open hopper cars, covered hopper cars, and box cars.

4. The railway car of claim 1, wherein the interior vertical support post has a cross section selected from the group consisting of hat-shaped, square, rectangular, oval, circular, U-shaped or C-shaped, and wherein the exterior vertical support post has a cross section selected from the group consisting of hat-shaped, square, rectangular, oval, circular, U-shaped or C-shaped.

5. The railway car of claim 1, wherein the interior vertical support post includes a first cut-out to accommodate the first longitudinal side sill of the railway car underframe and a second cut-out to accommodate a top chord of the railway car.

6. The railway car of claim 1, wherein the interior vertical support post is coupled to an interior surface of the first longitudinal side sill of the railway car underframe and an interior surface of a top chord of the railway car.

7. The railway car of claim 1, wherein the side sheet is generally flat across a length of the railcar.

8. A railway car, comprising:

a railway car underframe having a first longitudinal side sill and a second longitudinal side sill with a first sidewall assembly disposed along the first longitudinal side sill of the railway car underframe and a second sidewall assembly disposed along the second longitudinal side sill of the railway car underframe;

each of the first and second sidewall assemblies including first and second side sheets, a plurality of interior vertical support posts proximate a center of the railway car, and a plurality of exterior vertical support posts positioned between the plurality of interior vertical support posts and an end of the railway car;

each exterior vertical support post coupled to an exterior surface of a side sheet of the first and second side sheets; and each interior vertical support post coupled to an interior surface of a side sheet of the first and second side sheets.

9. The railway car of claim 8, wherein a longitudinal spacing distance between a first pair of adjacent exterior support posts of the plurality of exterior support posts is less than a longitudinal spacing distance between a second pair of adjacent exterior support posts of the plurality of exterior support posts, the second pair of adjacent exterior support posts further from the center of the railcar than the first pair of adjacent exterior support posts.

10. The railcar of claim 9, wherein the first pair of adjacent exterior support posts comprises first and second exterior support posts and the second pair of adjacent exterior support posts comprises the second exterior support posts and a third exterior support post, the first exterior support post closer to the center of the railcar than the second exterior support post and the third exterior support post further from the center of the railcar than the second exterior support post.

11. The railcar of claim 9, wherein the longitudinal spacing distance between the second pair of adjacent exterior support posts of the plurality of exterior support posts is less than a longitudinal spacing distance between a third pair of adjacent exterior support posts of the plurality of exterior support posts, the third pair of adjacent exterior support posts further from the center of the railcar than the second pair of adjacent exterior support posts.

12. The railcar of claim 8, wherein a depth of a first exterior support post of the plurality of exterior support posts is less than a second exterior support post of the plurality of exterior support posts, the first exterior support post closer to the center of the railcar than the second exterior support post.

13. The railway car of claim 8, wherein a first clearance width measured from an exterior surface of the side sheet of the first sidewall assembly to an exterior surface of the side sheet of the second sidewall assembly is less than a second clearance width measured from an exterior surface of the exterior vertical support post of the first sidewall assembly to an exterior surface of the exterior vertical support post of the second sidewall assembly.

14. The railway car of claim 8, wherein the railway car has a first end portion and a second end portion separated by a center portion; and the second clearance width corresponds to a width at the first and second end portions and the first clearance width corresponds to a width at the center portion.

15. The railway car of claim 8, wherein the railway car comprises a length of at least sixty-nine feet and a width within clearance limitations established by the Association of American Railroads including clearance limitations imposed on the railway car as the railway car travels around a thirteen degree curve.

16. The railway car of claim 8, wherein the railway car comprises a car selected from the group consisting of gondola cars, open hopper cars, covered hopper cars, and box cars.

17. A method of forming a railway car, comprising:

coupling first and second sidewall assemblies to a railway car underframe;

each of the first and second sidewall assemblies including first and second side sheets, a plurality of interior vertical support posts proximate a center of the railway car, and a plurality of exterior vertical support posts positioned between the plurality of interior vertical support posts and an end of the railway car;

each exterior vertical support post coupled to an exterior surface of a side sheet of the first and second side sheets; and each interior vertical support post coupled to an interior surface of a side sheet of the first and second side sheets.

18. The method of claim 17, wherein a longitudinal spacing distance between a first pair of adjacent exterior support posts of the plurality of exterior support posts is less than a longitudinal spacing distance between a second pair of adjacent exterior support posts of the plurality of exterior support posts, the second pair of adjacent exterior support posts further from the center of the railcar than the first pair of adjacent exterior support posts.

19. The method of claim 18, wherein the first pair of adjacent exterior support posts comprises first and second exterior support posts and the second pair of adjacent exterior support posts comprises the second exterior support posts and a third exterior support post, the first exterior support post closer to the center of the railcar than the second exterior support post and the third exterior support post further from the center of the railcar than the second exterior support post.

20. The method of claim 18, wherein the longitudinal spacing distance between the second pair of adjacent exterior support posts of the plurality of exterior support posts is less than a longitudinal spacing distance between a third pair of adjacent exterior support posts of the plurality of exterior support posts, the third pair of adjacent exterior support posts further from the center of the railcar than the second pair of adjacent exterior support posts.

21. The method of claim 17, wherein a depth of a first exterior support post of the plurality of exterior support posts is less than a second exterior support post of the plurality of exterior support posts, the first exterior support post closer to the center of the railcar than the second exterior support post.

22. The method of claim 17, wherein a first clearance width measured from an exterior surface of the side sheet of the first sidewall assembly to an exterior surface of the side sheet of the second sidewall assembly is less than a second clearance width measured from an exterior surface of the exterior vertical support post of the first sidewall assembly to an exterior surface of the exterior vertical support post of the second sidewall assembly.

23. The method of claim 17, wherein the railway car has a first end portion and a second end portion separated by a center portion; and the second clearance width corresponds to a width at the first and second end portions and the first clearance width corresponds to a width at the center portion.

24. The method of claim 17, wherein the railway car comprises a length of at least sixty-nine feet and a width within clearance limitations established by the Association of American Railroads including clearance limitations imposed on the railway car as the railway car travels around a thirteen degree curve.

25. The method of claim 17, wherein the railway car comprises a car selected from the group consisting of gondola cars, open hopper cars, covered hopper cars, and box cars.

* * * * *